US008461912B1

(12) United States Patent
Kumar

(10) Patent No.: US 8,461,912 B1
(45) Date of Patent: Jun. 11, 2013

(54) SWITCHED-CAPACITOR, CURVATURE-COMPENSATED BANDGAP VOLTAGE REFERENCE

(75) Inventor: Jayaraman Kumar, Chennai (IN)

(73) Assignee: ATMEL Corporation, San Jose, CA (US)

( * ) Notice: Subject to any disclaimer, the term of this patent is extended or adjusted under 35 U.S.C. 154(b) by 0 days.

(21) Appl. No.: 13/332,123

(22) Filed: Dec. 20, 2011

(51) Int. Cl.
*G05F 1/10* (2006.01)

(52) U.S. Cl.
USPC ..... 327/539

(58) Field of Classification Search
USPC ..... 327/530, 534–541, 543
See application file for complete search history.

(56) References Cited

U.S. PATENT DOCUMENTS 6,972,549 B2 * 12/2005 Brass et al. ..... 323/313
7,061,421 B1 * 6/2006 Xiao et al. ..... 341/155

OTHER PUBLICATIONS

Ker et al., "New Curvature-Compensation Technique for CMOS Bandgap Reference With Sub-1-V Operation," IEEE Transactions on Circuits and Systems-II: Express Briefs, 53(8): pp. 667-671, (Aug. 2006).
Tiew et al., "A Curvature Compensation Technique for Bandgap Voltage References Using Adaptive reference Temperature," 4 pp.
Malcovati et al., "Curvature Compensated BiCMOS Bandgap with 1 V Supply Voltage,", IEEE Journal of Solid-State Circuits, 36:7, 4 pages, (Jul. 2001).
Song et al., "A Precision Curvature-Compensated CMOS Bandgap Reference," IEEE Journal of Solid-State Circuits, SC-18(6): pp. 634-643, (Dec. 1983).
Tsividis et al., A Process-Insensitive High-Performance NMOS Operational Amplifier, IEEE Journal of Solid-State Circuits, SC-15(6): pp. 921-928, (Dec. 1980).
Vaart, Johanna, "Design of a low voltage high precision 0.35 um CMOS bandgap reference," ITN Linkopings University, thesis, pp. 1-64, (2006).
Tsividis, Y.P., "Accurate Analysis of Temperature Effects in Ie-Vbe Characteristics with Application to Bandgap Reference Sources," IEEE Journal of Solid-State Circuits, SC-15 (6): pp. 1076-1084, (Dec. 1980).
Stanescu et al., "Curvature-Compensated CMOS Bandgap Circuit with IV Supply voltage," Semiconductor Conference 2002, 2 (8-12): pp. 365-368 (Oct. 2002).
Guan et al., "A 3V 110uW3.1ppm/C Curvature-Compensated CMOS Bandgap Reference," IEEE Proceedings ISCAS 2006, pp. 21-26 (May 2006).

* cited by examiner

*Primary Examiner* — Lincoln Donovan
*Assistant Examiner* — Sibin Chen
(74) *Attorney, Agent, or Firm* — Fish & Richardson P.C.

(57) ABSTRACT

In a novel aspect, producing a reference bandgap voltage includes generating a proportional to absolute temperature (PTAT) voltage difference based on respective voltages across a first pair of diodes. The PTAT voltage difference is sampled and scaled using a switched-capacitor amplifier. The switched-capacitor amplifier also is used to sample and scale a difference in voltages across a second pair of diodes, one of which is biased with a PTAT current and the other of which is biased with a current that exhibits little or no linear temperature dependency. The scaled voltage differences are combined with a voltage corresponding to a voltage across the diode that is biased with the PTAT current so as to at least partially compensate for linear and non-linear temperature-dependent components of the voltage across the diode.

17 Claims, 4 Drawing Sheets

SWITCHED-CAPACITOR, CURVATURE-COMPENSATED BANDGAP VOLTAGE REFERENCE

FIELD OF THE DISCLOSURE

This disclosure relates to switched-capacitor, curvature-compensated bandgap voltage references.

BACKGROUND

A bandgap voltage reference circuit generates a reference voltage that is substantially temperature-independent over a desired temperature range and is widely used in integrated circuits.

In some techniques, two components contribute to the output voltage of a bandgap voltage reference. One component is the base-emitter voltage (Vbe) of a diode-configured transistor. The second component is proportional to absolute temperature (PTAT) and is used to compensate for the negative temperature coefficient of Vbe. By multiplying the PTAT voltage with an appropriate factor and summing with Vbe, the bandgap voltage reference will have a low sensitivity to temperature variation.

For example, the voltage difference ΔVbe between two p-n junctions (e.g., diodes), operated at different current densities, can be used to generate a proportional to the absolute temperature (PTAT) current in a first resistor. The PTAT current can be used to generate a voltage in a second resistor. This voltage, in turn, is added to the voltage across one of the junctions. As the voltage across a diode operated with a PTAT current is complementary to absolute temperature (CTAT), if the ratio between the first and second resistors is chosen properly, the first order effects of the temperature dependency of the diode and the PTAT current will cancel out.

It is known, however, that even for a bandgap with an optimally chosen reference temperature $T_0$, the output voltage as a function of temperature displays a curvature that causes it to decrease for temperatures higher or lower than $T_0$ (see FIG. 1). The deviation in output voltage indicated by the curvature as the temperature varies is too large for many applications. Thus, it is desirable to incorporate a curvature correction technique so as to provide a bandgap voltage reference that displays even less temperature, sensitivity.

SUMMARY

In one novel aspect, a method of producing a reference bandgap voltage includes generating a proportional to absolute temperature (PTAT) voltage difference based on respective voltages across a first pair of diodes. The PTAT voltage difference is sampled and scaled using a switched-capacitor amplifier. The switched-capacitor amplifier also is used to sample and scale a difference in voltages across a second pair of diodes, one of which is biased with a PTAT current and the other of which is biased with a current that exhibits little or no linear temperature dependency. The scaled voltage differences are combined with a voltage corresponding to a voltage across the diode that is biased with the PTAT current so as to compensate for linear and non-linear temperature-dependent components of the voltage across the diode. Circuits for producing the reference bandgap voltage also are disclosed.

Some implementations include one or more of the following features. For example, the first pair of diodes can include a first diode and a second diode, and the second pair of diodes can include the first diode and a third diode. In this way, the method and circuit can be implemented using three diodes.

In some implementations, the PTAT voltage difference is scaled based, at least in part, on a first capacitance, and the difference between the voltages across the first and third diodes can be scaled based, at least in part, on a second capacitance. Signals from a two-phase clock can control switches so that during a first clock phase, an anode of the first diode is coupled electrically to each of first and second capacitances, and so that during a second clock phase, an anode of the second diode is coupled electrically to the first capacitance and an anode of the third diode is coupled electrically to the second capacitance.

In some implementations, the disclosed circuit design can result in reduced area requirements because fewer resistors are needed. The reduce area requirements can, in turn, result in lower manufacturing costs.

Other potential aspects, features and advantages will be apparent from the following detailed description, the accompanying drawings and the claims.

DETAILED DESCRIPTION

The circuit described in this disclosure uses a switched-capacitor amplifier to sample and scale voltage values so as to generate a bandgap voltage reference (Vbgap). The circuit components (other than the diodes) can be implemented, for example, in a CMOS integrated circuit. The diodes can be implemented, for example, using bipolar junction transistors (BJTs) connected in a diode configuration.

The circuit generates a voltage difference (ΔVbe) between respective voltages across first and second diodes (D1, D2) having unequal emitter areas and, thus, unequal current densities. The voltage difference ΔVbe is a PTAT voltage and represents a linear error voltage that subsequently is scaled to adjust the temperature-dependent slope of the voltage (Vbe) across one of the diodes so as to compensate for, and effectively cancel, the linear temperature-dependent (i.e., CTAT) component of the voltage Vbe. See FIG. 2, block 100. In particular, the voltage difference (ΔVbe) is sampled and amplified using a switched-capacitor amplifier (FIG. 2, block 102), and the amplified voltage difference is added to a voltage that corresponds to the voltage (Vbe) across the first diode.

Figure 2:
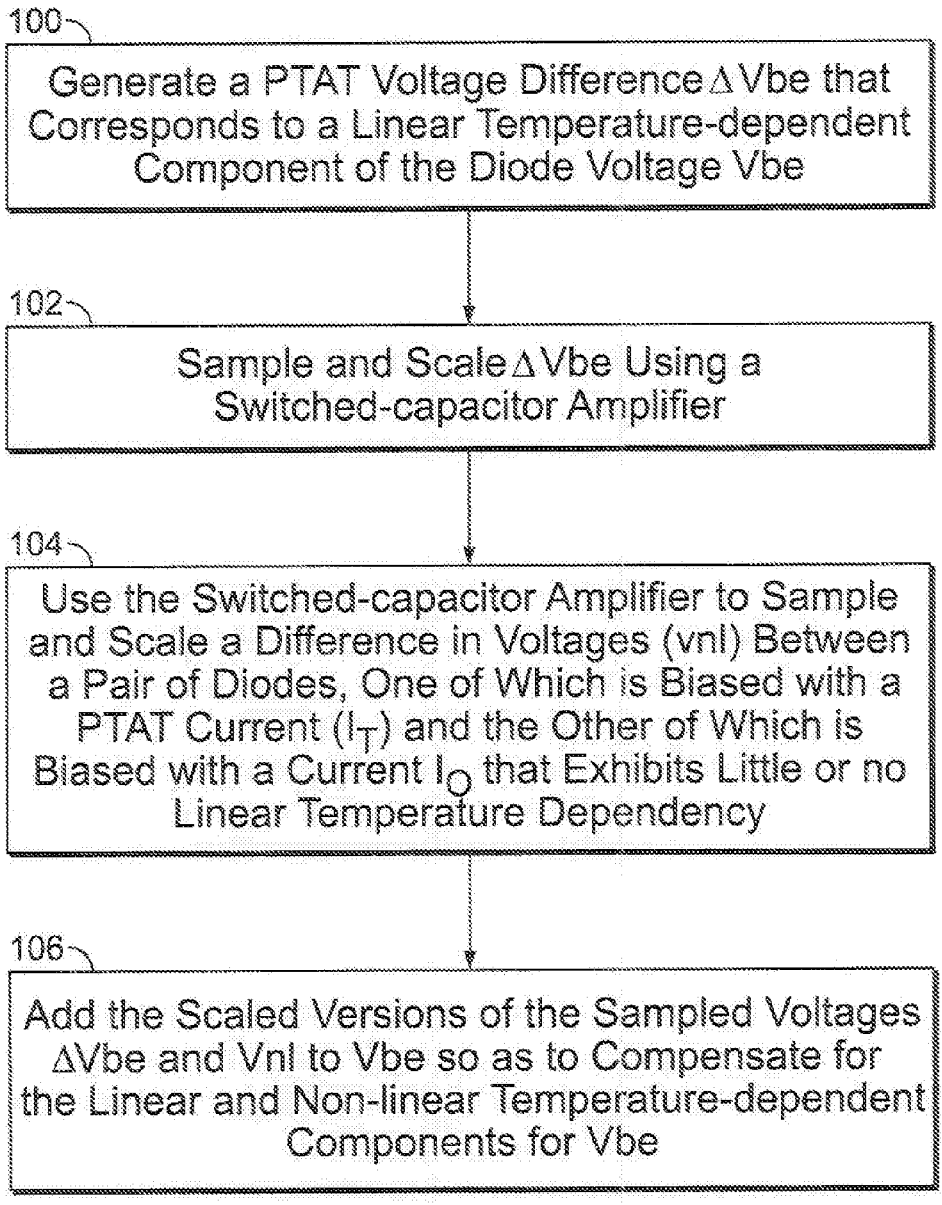
FIG. 2 is a flow chart illustrating an example of a method according to a novel aspect of the disclosure.

In addition, the difference in the voltage across the first diode (D1)—which is biased with a PTAT current ($I_T$)—and the voltage across a third diode (D3)—which is biased with a current $I_O$ that exhibits little or no linear temperature dependency—is sampled and scaled using the switched-capacitor amplifier to compensate for, and effectively cancel, the non-linear temperature dependency of Vbe (FIG. 2, block 104).

The circuit thus uses a switched-capacitor amplifier to sample and scale both the linear temperature-dependent error component and the non-linear temperature-dependent error component to obtain a stable bandgap voltage reference (Vbgap) that is relatively independent of temperature. In particular, the switched capacitor topology is used to sample ΔVbe and to sample the voltage between two diodes, one of which is biased with a current that exhibits little or no linear temperature dependency and the other of which is biased with a PTAT current. Adding the scaled versions of the linear error voltage ΔVbe and the non-linear error voltage (Vnl) to the diode voltage Vbe can result in a curvature-compensated bandgap voltage reference (Vbgap). The values of the capacitances can be adjusted so as to compensate for the temperature-dependent slope of Vbe and its non-linear error term.

Figure 3:
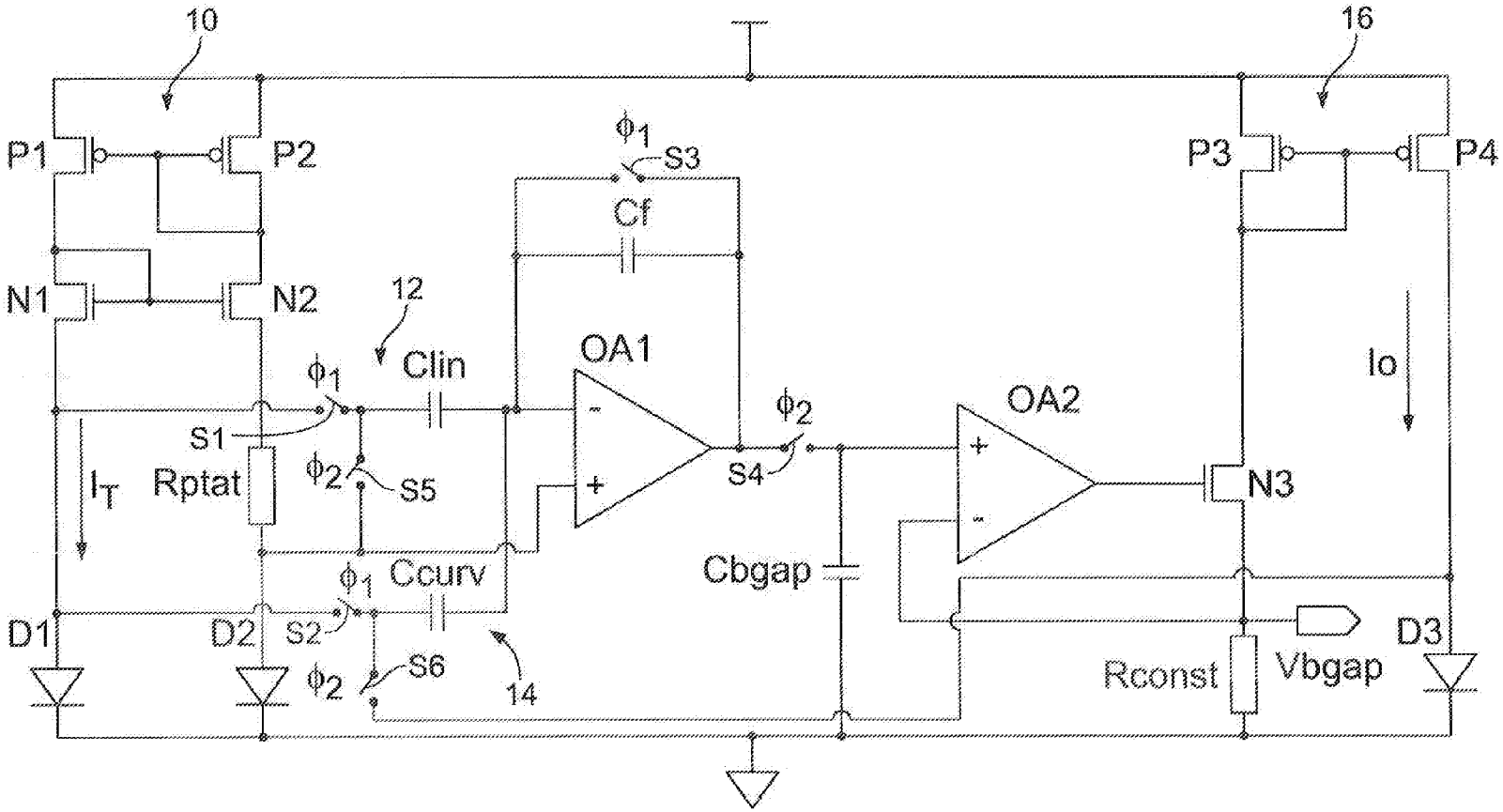
FIG. 3 illustrates an example of a circuit that provides a switched-capacitor, curvature-compensated bandgap voltage reference according to a novel aspect of the disclosure.

As illustrated in the example of FIG. 3, the circuit includes a bias core or self-bias loop 10 for generating the PTAT current ($I_T$). The circuit also includes circuitry 12 to sample the linear error voltage Vbe and circuitry 14 to sample the non-linear error voltage Vnl. A first operational amplifier OA1 with a feedback capacitance Cf provides the desired scaling. The circuit also includes circuitry 16 to generate the current $I_O$ that exhibits little or no linear temperature dependency.

The self-bias loop 10 for generating the PTAT current $I_T$ includes a pair of NMOS transistors N1, N2 and a current mirror formed of a pair of PMOS transistors P1, P2. As show in FIG. 3, the gates of the two PMOS transistors P1, P2 are electrically coupled together, and the gate of transistor P2 is electrically coupled to its drain. Likewise, the gates of the two NMOS transistors N1, N2 are electrically coupled together, and the gate of transistor N1 is electrically coupled to its drain. The drain of transistor P1 is electrically coupled to the drain of transistor N1, and the drain of transistor P2 is electrically coupled to the drain of transistor N2. Furthermore, the source of transistor N1 is electrically coupled to the anode of a first diode D1. The source of transistor N2 is electrically coupled one end of a resistor Rptat, the other end of which is electrically coupled to the anode of a second diode D2. The cathodes of the diodes D1, D2 are electrically coupled to ground.

The self-bias loop 10 causes the voltage at the anode of the first diode D1 to appear on the resistor Rptat (i.e. at the node connecting resistor Rptat to the source of transistor N2). The current through resistor Rptat can be expressed as ΔVbe/Rptat, where ΔVbe is the difference in voltages across diodes D1 and D2. Furthermore, the current through resistor Rptat increases with temperature. The current ($I_T$) through the first diode D1 is equal to the current through resistor Rptat because of the current mirror formed by transistors P1, P2.

As shown in FIG. 3, the voltage (Vbe) across the second diode D2 appears at the non-inverting input (+) of a first operational amplifier OA1.

Figure 1:
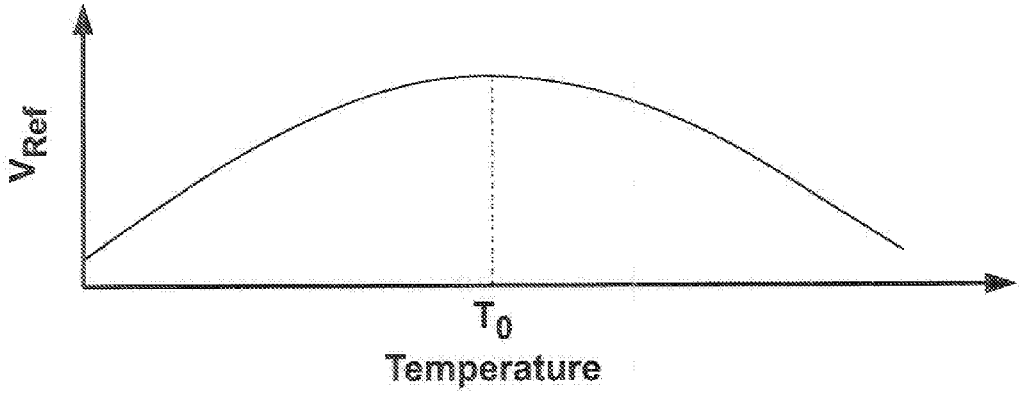
FIG. 1 illustrates an example of temperature variation versus output voltage for some bandgap voltage references
Figure 4:
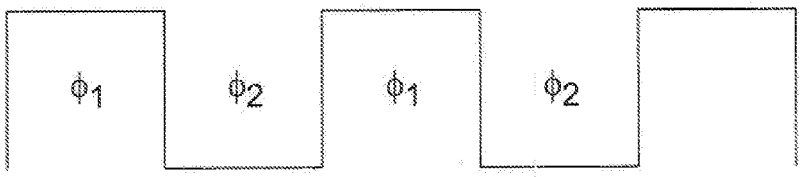
FIG. 4 is an example of a clock signal for use with the circuit of FIG. 3

The circuit uses a 2-phase clock (ϕ1, ϕ2) to open/close various switches S1 through S6, which can be implemented, for example, as MOS transistors. See FIG. 4. Switches labeled ϕ1 are closed when the clock signal goes high, whereas switches labeled ϕ2 are closed when the clock signal goes low. Likewise, switches labeled ϕ1 are open when the clock signal goes low, whereas switches labeled ϕ2 are open when the clock signal goes high.

For example, during the first clock phase, switch S3 is closed and discharges capacitance Cf, thereby readying the capacitance Cf to store charge coming from capacitances Clin and Ccurv during the next clock phase. In particular, during the next clock phase, when switch S1 opens and switch S5 closes, the voltage (and hence the charge) across capacitance Clin changes. This charge difference is transferred to the capacitor Cf, thus resulting in a scaling of the linear error voltage (ΔVbe) by an amount Clin/Cf. Likewise, another amount of charge accumulates at the same time as a result of switch. S2 opening and switch S6 closing, which results in scaling of the non-linear error voltage (Vnl) by the ratio of the capacitances Ccurv/Cf.

In general, since the operational amplifier OA1 forces its two inputs to be equal, the plate of the capacitance Cf that is connected to the inverting input (−) of the operational amplifier OA1 is at voltage Vbe. The difference in the voltage across the capacitance Cf equals the sum of two scaled voltages. Therefore, the total voltage across capacitance Cf includes the sum of these two scaled voltages. In particular, the plate of the capacitance Cf that is connected to the output of the operational amplifier OA1 will be the sum of Vbe and the scaled voltages. Operation of the circuit is explained in greater detail in the following paragraphs.

When the clock signal goes high, switches S1, S2 and S3 are closed. When the clock signal subsequently transitions to a low signal and the switches S1, S2 and S3 open, the difference (ΔVbe) between the voltages across diodes D1 and D2 is scaled by the ratio of the capacitances Clin/Cf, and the scaled voltage appears at the output of the first operational amplifier OA1. In this case, Clin is a capacitance connecting the anode of the first diode D1 to the inverting input (−) of the operational amplifier OA1, and Cf is a feedback capacitance for the operational amplifier OA1. Thus, during the second clock phase (i.e., when the clock signal goes low), the voltage at the output of the first operational amplifier OA1 includes a scaled version of the voltage (Vbe) across diode D2 and the voltage difference (ΔVbe). As mentioned above, the voltage difference ΔVbe represents a linear error voltage that compensates for the linear temperature dependency of Vbe. In particular, the voltage Vbe decreases as temperature increases, whereas the voltage difference (ΔVbe) increases as temperature increases. In this way, the linear temperature dependency of the voltage Vbe is compensated for and, therefore, can be substantially canceled.

During the latter part of the second clock phase (i.e., when the clock signal is low), a switch S4 coupled to the output of the first amplifier OA1 closes, and the output voltage is sampled by a capacitor Cbgap connected between the non-inverting input (+) of a second operational amplifier OA2 and ground.

The output of the second operational amplifier OA2 is connected to the gate of a NMOS transistor N3, which, in turn, has its source electrically coupled to a first end of a resistance Rconst. The first end of the resistance Rconst also is coupled electrically to the inverting input (−) of the second amplifier OA2. The other end of the resistor Rconst is coupled to ground. This configuration causes the sampled voltage from the output of the first operational amplifier OA1 to be superimposed across the resistance Rconst. This voltage, which is labeled Vbgap, generates a current equal to Vbgap/Rconst through the resistance Rconst and the transistor N3. Since the sampled voltage Vbgap does not exhibit any significant linear temperature dependency, the current through the resistor Rconst also is substantially independent of temperature (i.e., exhibits substantially no linear temperature dependency).

The drain of transistor N3 is coupled electrically to a current mirror formed of PMOS transistors P3 and P4. This current mirror generates a current $I_O$ equal to the current through the resistor Rconst (i.e., Vbgap/Rconst), which, as noted above, is substantially independent of temperature in that it exhibits little or no linear temperature dependency.

The current $I_O$ flows through a third diode D3, whose anode is electrically coupled to the drain of transistor P4 and whose cathode/anode is coupled to ground. Since the current $I_O$ exhibits little or no linear temperature dependency, the voltage across the third diode D3 also exhibits little or no linear temperature dependency. The voltage across the third diode D3 and the voltage across the first diode D1 are used to generate the non-linear error voltage Vnl.

In particular, during the second clock phase (i.e., when the clock signal is low), two additional switches S5 and S6 are closed. Closing switch S6 electrically couples the voltage across the third diode D3 to the inverting input (−) of the first operational amplifier OA1 through a capacitance Ccurv. Thus, during the second clock phase, the first operational amplifier OA1 scales the voltage difference (Vnl) between the voltages across the first and third diodes D1, D3 by the ratio of the capacitances Ccurv/Cf. The difference (Vnl) between the voltages across diodes D1 and D3 is proportional to the non-linear temperature-dependent component of the voltage across diode D1. The scaled voltage (Ccurv/Cf)*Vnl appears at the output of the first operational amplifier OA1 and is added to the voltage value Vbe and the scaled linear error voltage value (Clin/Cf)*ΔVbe. Thus, when switch. S4 is closed toward the end of the second clock phase, the following voltage value appears at the non-inverting input (+) of the second amplifier OA2:

$$Vbe+(Clin/Cf)*\Delta Vbe+(Ccurv/Cf)*Vnl.$$

As explained above, the voltage appearing at the non-inverting input (+) of the second operational amplifier OA2 also appears across the resistance Rconst. The bandgap voltage reference (Vbgap) can be obtained from the node connecting the resistance Rconst to the inverting input (−) of the second operational amplifier OA2.

Figure 5:
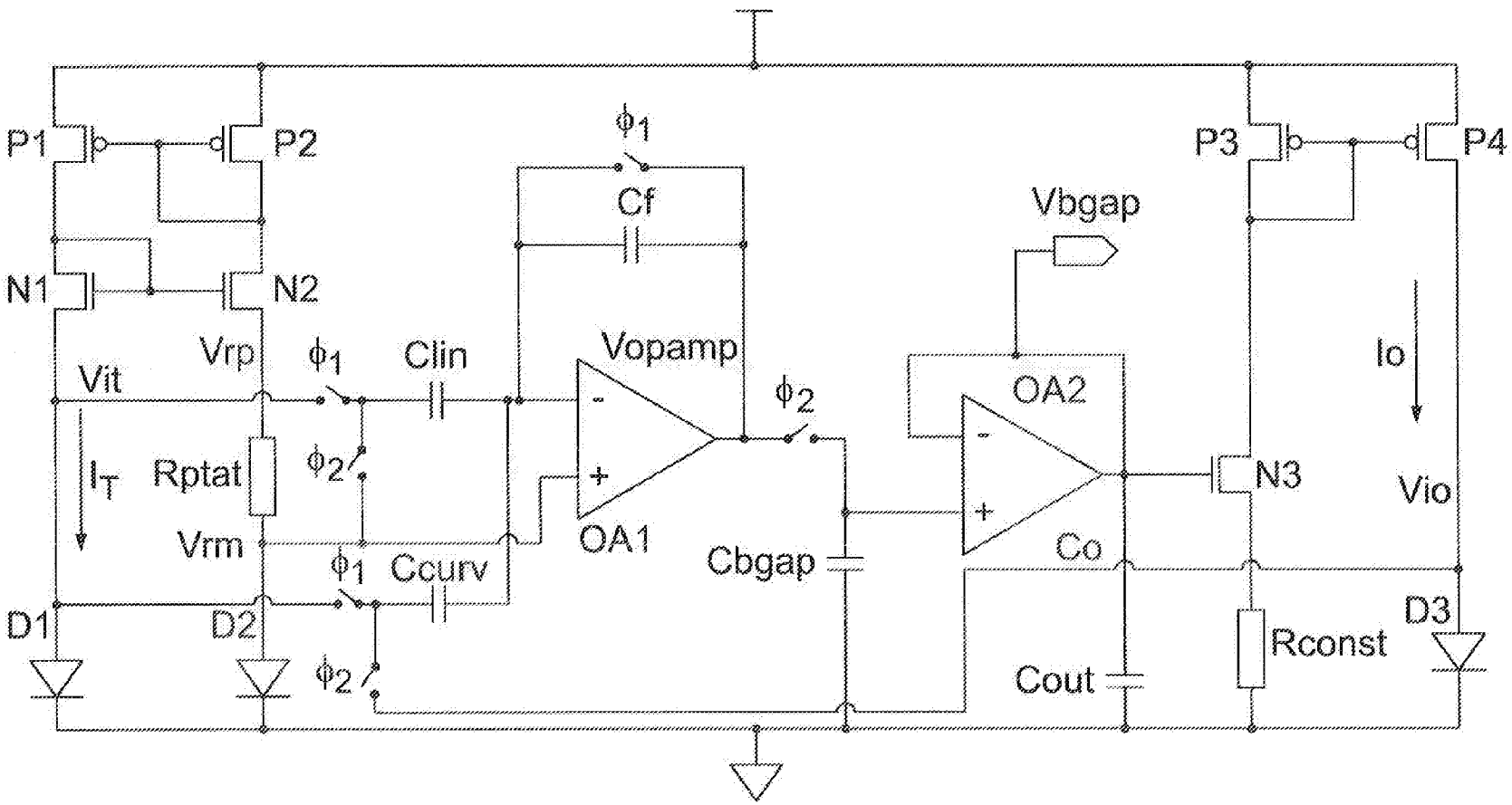
FIG. 5 illustrates another implementation of a circuit that provides a switched-capacitor, curvature-compensated bandgap voltage reference according to a novel aspect of the disclosure.

FIG. 5 illustrates another example of a circuit that provides a switched-capacitor, curvature-compensated bandgap voltage reference. The circuit of FIG. 5 is substantially similar to the circuit of FIG. 3, except that the reference bandgap voltage is obtained from a different point in the circuit. In particular, the inverting input (−) of the second operational amplifier OA2 is electrically coupled to the output of the second operational amplifier OA2, which is electrically coupled to transistor N3. In addition, a capacitor Cout is coupled between the output of the second operational amplifier OA2 and ground. The reference bandgap voltage (Vbgap) is obtained at the output of the second operational amplifier OA2

In general, the configuration of FIG. 5 is likely to be less accurate than the configuration of FIG. 3. Instead of a temperature-independent bandgap voltage (Vbgap), the voltage across the resistance Rconst will be equal to Vbgap-Vth, where Vth is the threshold voltage of transistor N3. As (Vbgap-Vth)/Rconst is less temperature-independent compared to Vbgap/Rconst, the accuracy of the circuit may tend to be reduced slightly. On the other hand, a potential advantage is that the second operational amplifier OA2 can be used as a buffer so that the voltage Vbgap may be impacted less by some types of loading connected to it.

Other implementations are within the scope of the claims.

What is claimed is:

1. A method of producing a reference bandgap voltage, the method comprising:

generating a proportional to absolute temperature (PTAT) voltage difference based on respective voltages across a first pair of diodes;

sampling and scaling the PTAT voltage difference using a switched-capacitor amplifier;

using the switched-capacitor amplifier to sample and scale a difference in voltages across a second pair of diodes, one of which is biased with a PTAT current and the other of which is biased with a current that exhibits little or no linear temperature dependency; and combining the scaled voltage differences with a voltage corresponding to a voltage across the diode that is biased with the PTAT current so as to at least partially compensate for linear and non-linear temperature-dependent components of the voltage across the diode.

2. The method of claim 1 wherein the first pair of diodes includes a first diode and a second diode, and wherein the second pair of diodes includes the first diode and a third diode.

3. The method of claim 2 wherein the first diode is biased with the PTAT current.

4. The method of claim 2 wherein the current exhibiting little or no linear temperature dependency that is used to bias the third diode is generated by superimposing an output voltage from the switched-capacitor amplifier onto a resistance and mirroring a current flowing through the resistance.

5. The method of claim 1 using a two-phase clock to sample and scale the PTAT voltage difference and to sample and scale the difference in voltages across the second pair of diodes.

6. The method of claim 5 wherein the PTAT voltage difference is scaled based, at least in part, on a first capacitance, and wherein the difference in voltages across the second pair of diodes is scaled based, at least in part, on a second capacitance.

7. The method of claim 2 including:

using a two-phase clock to sample and scale the PTAT voltage difference between the voltages across the first and second diodes and to sample and scale the difference in voltages across the first and third diodes; and scaling the PTAT voltage difference based, at least in part, on a first capacitance, and scaling the difference in voltages across the first and third diodes based, at least in part, on a second capacitance, wherein signals from the clock control switches so that during a first clock phase, an anode of the first diode is coupled electrically to each of first and second capacitances, and so that during a second clock phase, an anode of the second diode is coupled electrically to the first capacitance and an anode of the third diode is coupled electrically to the second capacitance.

8. A circuit for producing a reference bandgap voltage, the circuit comprising:

a first pair of diodes;

a second pair of diodes, one of which is biased with a PTAT current and the other of which is biased with a current that exhibits little or no linear temperature dependency;

circuitry to generate a proportional to absolute temperature (PTAT) voltage difference based on respective voltages across the first pair of diodes;

a switched-capacitor amplifier to sample and scale the PTAT voltage difference and to sample and scale a difference in voltages across the second pair of diodes; and circuitry to combine the scaled voltage differences with a voltage corresponding to a voltage across the diode that is biased with the PTAT current so as to at least partially compensate for linear and non-linear temperature-dependent components of the voltage across the diode.

9. The circuit of claim 8 wherein the first pair of diodes includes a first diode and a second diode, and wherein the second pair of diodes includes the first diode and a third diode.

10. The circuit of claim 9 wherein the first diode is biased with the PTAT current.

11. The circuit of claim 9 further including a resistance and a current mirror, wherein an output of the switch-capacitor amplifier is superimposed on the resistance to generate a current which is mirrored by the current mirror to generate the current that exhibits little or no linear temperature dependency.

12. The circuit of claim 8 including a plurality of switches and a two-phase clock to control respective states of the switches so as to sample and scale the PTAT voltage difference and to sample and scale the difference in voltages across the second pair of diodes.

13. The circuit of claim 12 including a first capacitance and a second capacitance, wherein the PTAT voltage difference is scaled based, at least in part, on the first capacitance, and wherein the difference in voltages across the second pair of diodes is scaled based, at least in part, on the second capacitance.

14. A circuit for producing a reference bandgap voltage, the circuit comprising:

a first diode biased with a PTAT current;

a second diode;

a third diode biased with a current that exhibits substantially no linear temperature dependency;

circuitry to generate a proportional to absolute temperature (PTAT) voltage difference based on respective voltages across the first and second diodes;

a switched-capacitor amplifier to sample and scale the PTAT voltage difference and to sample and scale a difference in voltages across the first and third diodes; and circuitry to combine the scaled voltage differences with a voltage corresponding to a voltage across the diode that is biased with the PTAT current so as to at least partially compensate for linear and non-linear temperature-dependent components of the voltage across the diode.

15. The circuit of claim 14 including a plurality of switches and a two-phase clock to control respective states of the switches so as to sample and scale the PTAT voltage difference and to sample and scale the difference in voltages across the first and third diodes.

16. The circuit of claim 15 including a first capacitance and a second capacitance, wherein the PTAT voltage difference is scaled based, at least in part, on the first capacitance, and wherein the difference in voltages across the first and third diodes is scaled based, at least in part, on the second capacitance.

17. The circuit of claim 16 wherein the clock controls the switches so that during a first clock phase, each of the first and second capacitances is coupled electrically to an anode of the first diode, and during a second clock phase, the first capacitance is coupled electrically to an anode of the second diode, and the second capacitance is coupled electrically to an anode of the third diode.

* * * * *

UNITED STATES PATENT AND TRADEMARK OFFICE

CERTIFICATE OF CORRECTION

PATENT NO. : 8,461,912 B1
APPLICATION NO. : 13/332123
DATED : June 11, 2013
INVENTOR(S) : Jayaraman Kumar It is certified that error appears in the above-identified patent and that said Letters Patent is hereby corrected as shown below:

1). Title Page, prior publication data was omitted: after the section labeled "(22) Filed", insert the following item and publication data:
--(65) Prior Publication Data US 2013/0154721 June 20, 2013--.

In the Specification

2.) Column 1, Line 44: delete "temperature, sensitivity" and insert --temperature sensitivity--.

3.) Column 3, Line 17: delete "Vbe" and insert --ΔVbe--.

4.) Column 3, Line 41: delete "(i.e." and insert --(i.e.,--.

Signed and Sealed this
Twenty-sixth Day of November, 2013

Margaret A. Focarino

Margaret A. Focarino
*Commissioner for Patents of the United States Patent and Trademark Office*